US009281601B2

(12) United States Patent
Okayasu et al.

(10) Patent No.: US 9,281,601 B2
(45) Date of Patent: Mar. 8, 2016

(54) PIN TERMINAL

(75) Inventors: Yasushi Okayasu, Yokkaichi (JP); Satoru Izukura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 28 days.

(21) Appl. No.: 14/354,290

(22) PCT Filed: Mar. 1, 2012

(86) PCT No.: PCT/JP2012/055184
§ 371 (c)(1), (2), (4) Date: Apr. 25, 2014

(87) PCT Pub. No.: WO2013/061631
PCT Pub. Date: May 2, 2013

(65) Prior Publication Data

US 2014/0329396 A1 Nov. 6, 2014

(30) Foreign Application Priority Data

Oct. 25, 2011 (JP) ..... 2011-233818

(51) Int. Cl.
*H01R 13/44* (2006.01)
*H01R 13/04* (2006.01)
*H01R 13/629* (2006.01)

(52) U.S. Cl.
CPC ..... *H01R 13/44* (2013.01); *H01R 13/04* (2013.01); *H01R 13/629* (2013.01)

(58) Field of Classification Search
CPC ..... H01R 13/04; H01R 13/44; H01R 13/639
See application file for complete search history.

(56) References Cited

U.S. PATENT DOCUMENTS 3,272,539 A * 9/1966 Asbury, Sr. ..... 285/332.4
4,793,822 A * 12/1988 Cozzens ..... H01R 4/2475 439/397
5,336,113 A * 8/1994 Chanteau ..... H01R 4/32 439/581
5,391,088 A * 2/1995 Tomchak ..... H01R 25/162 439/216
5,921,801 A * 7/1999 O'Sullivan ..... H01R 13/748 439/362
6,146,211 A 11/2000 Okamoto et al.

(Continued)

FOREIGN PATENT DOCUMENTS

JP 2000-3750 1/2000
JP 2000-91014 3/2000

(Continued)

OTHER PUBLICATIONS

International Search Report of May 22, 2012.

*Primary Examiner* — Truc Nguyen
(74) *Attorney, Agent, or Firm* — Gerald E. Hespos; Michael J. Porco; Matthew T. Hespos

(57) ABSTRACT

A pin terminal (PT) is such that a cap (30) made of synthetic resin is attached to a tip part of a terminal main body (10) made of metal and in the form of a round pin. An attachment hole (21) including an uninterrupted and continuous peripheral wall over the entire circumference is perforated on the tip surface of the terminal main body (10), whereas a press-fitting portion (35) to be press-fitted into the attachment hole (21) is formed to project on the rear surface of the cap (30). An internal thread (23) is formed on the peripheral surface of the attachment hole (21), and a ridge portion (24) of this internal thread (23) constitutes a biting protrusion. The tip of the pin terminal (PT) is structured to form a smooth and tapered guiding portion (40).

9 Claims, 11 Drawing Sheets

(56) References Cited

U.S. PATENT DOCUMENTS 6,149,472 A * 11/2000 Endo ..... H01R 13/434
439/745
2005/0159041 A1* 7/2005 Holliday ..... H01R 4/5025
439/500
2006/0199445 A1* 9/2006 Schaty ..... H01R 4/64
439/859
2007/0202735 A1* 8/2007 Hanks ..... H01R 4/5033
439/427
2011/0065335 A1* 3/2011 Hain ..... H01R 4/301
439/810

FOREIGN PATENT DOCUMENTS

JP 2000-150040 5/2000
JP 2006-339167 12/2006

* cited by examiner

PIN TERMINAL

BACKGROUND

1. Field of the Invention

This invention relates to a pin terminal provided with a cap for preventing electrification.

2. Description of the Related Art

A measure is taken to prevent electrification, such as when a high current is applied, by attaching a cap made of synthetic resin, which is an insulating material, to a tip part of a pin terminal applied, for example, to a charging connector.

Conventionally, an example of a simply structured prevention means is known from Japanese Unexamined Patent Publication No. 2000-150040. This is structured such that a cap is formed into a tubular shape with a closed front surface and, on the other hand, an attachment portion with a small diameter is formed on a tip part of a pin terminal and the cap is press-fitted onto the outer periphery of the attachment portion to be fixed.

In the pin terminal applied to a charging connector as described above, a holding force of the cap is problematic since the pin terminal is used by being frequently inserted into and withdrawn from a mating socket terminal.

Here, synthetic resin as a material of the cap has a higher coefficient of thermal expansion than metal. Thus, in the pin terminal having the cap externally fitted on the attachment portion thereof as described above, if the cap is thermally expanded, such as due to exposure to a high-temperature atmosphere, it becomes loose on the attachment portion due to an increased inner diameter, i.e. comes to have a poor holding force. Therefore, there has been a desire for improvement.

The present invention was completed based on the above situation and aims to increase a holding force of a cap while maintaining a simple structure.

SUMMARY OF THE INVENTION

The present invention is directed to a pin terminal in which a cap made of synthetic resin is attached to a tip part of a terminal main body made of metal and in the form of a round pin, wherein an attachment hole including an uninterrupted and continuous peripheral wall over the entire circumference is perforated on the tip surface of the terminal main body, whereas a press-fitting portion to be press-fitted into the attachment hole is formed to project on the rear surface of the cap.

The cap is fixed while covering the tip surface of the terminal main body by press-fitting the press-fitting portion on the rear surface of the cap into the attachment hole on the tip surface of the terminal main body. If the cap is thermally expanded, the outer diameter of the press-fitting portion increases. However, since the attachment hole includes the uninterrupted and continuous peripheral wall and maintains a constant inner diameter, leaving no room for expansion, a degree of press-fitting increases as the outer diameter of the press-fitting portion increases, with the result that a holding force also increases.

Specifically, the holding force of the cap onto the terminal main body is increased while a simple structure is maintained.

Further, the following configurations may be adopted.

(1) A biting protrusion is formed in a circumferential direction on the peripheral surface of the attachment hole. As the press-fitting portion is press-fitted, the biting protrusion formed in the circumferential direction bites into the outer periphery of the press-fitting portion and creates resistance in a detaching direction of the cap, whereby the holding force is further increased.

(2) An internal thread is formed on the peripheral surface of the attachment hole and a ridge portion of the internal thread constitutes the biting protrusion. Since resistance is created in the detaching direction over a long range of the press-fitting portion, the holding force is further increased. The internal thread itself can be easily formed such as using a tap.

(3) A longitudinal groove for air vent is formed over the entire length on the outer periphery of the press-fitting portion of the cap.

If air is sealed at the back of the attachment hole and this air is thermally expanded, a force in the detaching direction may act on the press-fitting portion, i.e. on the cap. However, since the expanded air is allowed to escape to the outside through the longitudinal groove, the action of the force in the detaching direction is avoided. As a result, the holding force is indirectly increased.

(4) The cap is formed into a substantially truncated conical shape and attached in the center of the tip surface of the terminal main body having a diameter larger than a maximum diameter of the cap, and a tapered surface whose tip side has a diameter smaller than the maximum diameter of the cap is formed on a corner part of the tip of the terminal main body.

A smooth and tapered guiding portion is formed from the outer surface of the cap to the tapered surface on the tip part of the terminal main body. In inserting the pin terminal into a mating socket terminal, an inserting force can be reduced.

According to the pin terminal of the present invention, it is possible to increase the holding force of the cap on the terminal main body while maintaining a simple structure.

DETAILED DESCRIPTION OF THE PREFERRED EMBODIMENTS

A first embodiment of the present invention is described with reference to FIGS. 1 to 6.

A pin terminal PT of this embodiment is mounted in a vehicle side connector constituting one side of a charging connector of a vehicle, and fitted and connected to a socket terminal (not shown) mounted in a power-supply side connector as a mating power-supply side connector is connected.

Figure 1:
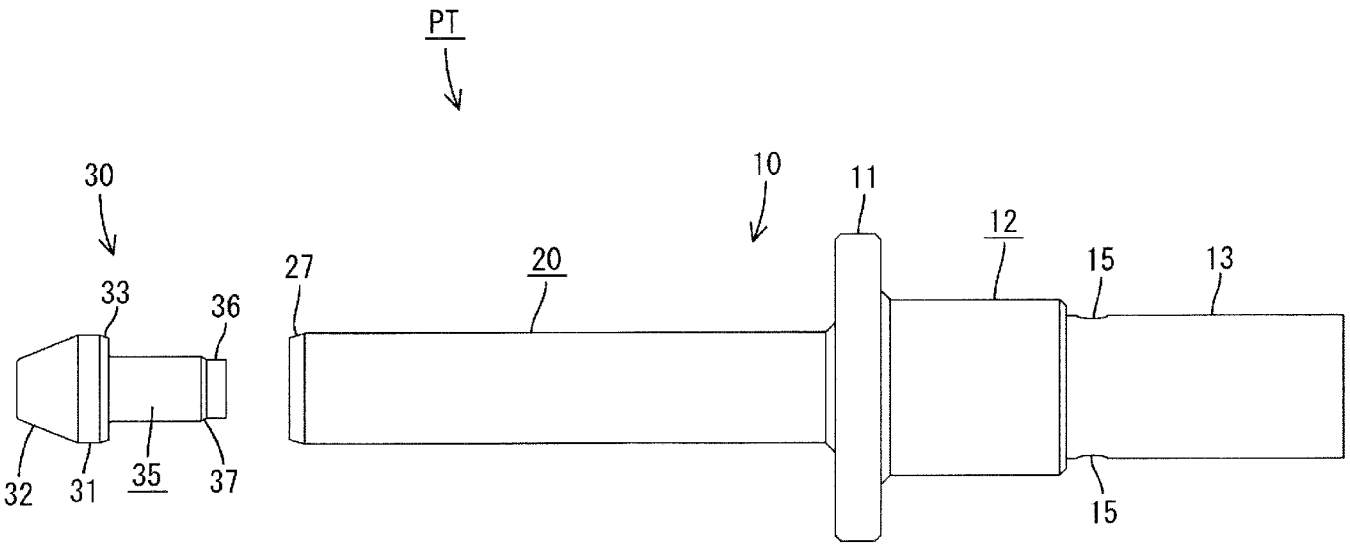
FIG. 1 is a plan view showing a state of a pin terminal according to a first embodiment of the present invention before being assembled.
Figure 2:
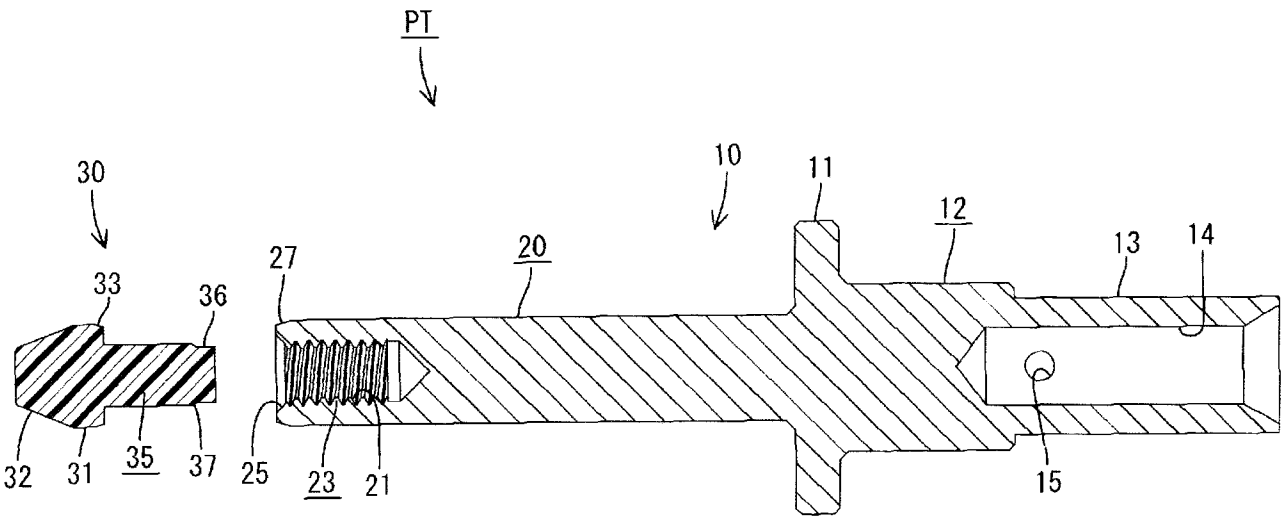
FIG. 2 is a longitudinal section of the pin terminal.
Figure 3:
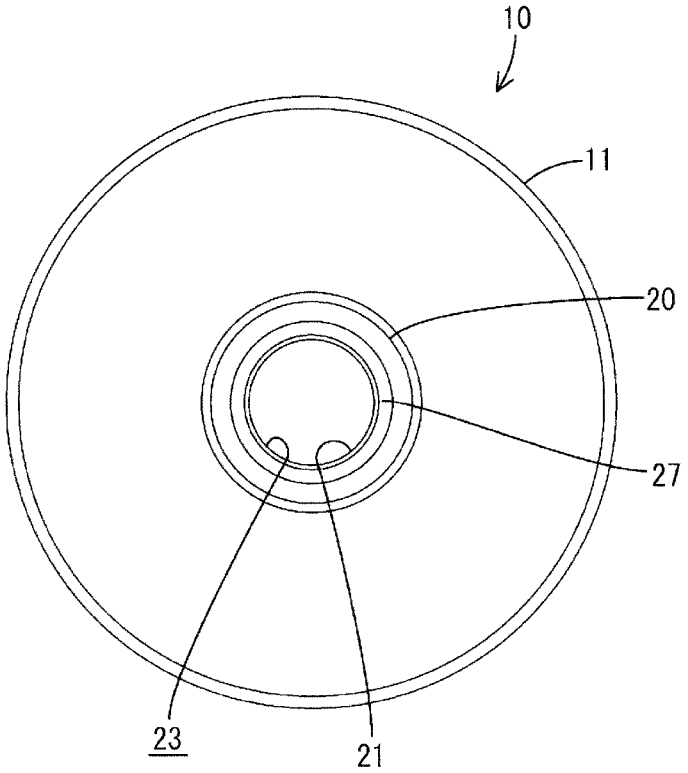
FIG. 3 is a front view of a terminal main body.

As shown in FIGS. 1 and 2, the pin terminal PT is composed of a terminal main body 10 and a cap 30 to be attached to the tip of the terminal main body 10.

The terminal main body 10 is formed of a round bar as a base material made of metal such as copper or copper alloy and formed into a long and narrow round pin shape as a whole by way of processes such as heading and cutting, and silver plating is applied to the outer surface after the terminal main body 10 is formed into a final shape.

A flange 11 is formed at a position of the terminal main body 10 slightly displaced to the back from a center position in a length direction, and a side behind this flange 11 serves as a wire connecting portion 12 to be connected to a wire and a side before it serves as a terminal connecting portion 20 to be connected to the mating socket terminal. Note that the flange 11 is used for positioning in the case of mounting the pin terminal PT into a terminal accommodating chamber in a housing of the vehicle side connector.

The wire connecting portion 12 is formed to have a stepped shape with a slightly narrower rear side, and a narrowed portion is formed with a center hole 14 which is open on the rear surface, thereby forming a closed barrel 13. An end of a core of the wire exposed by an end processing is inserted into the center hole 14 of the above closed barrel 13 and connected by crimping, whereby the terminal main body 10, i.e. the pin terminal PT is connected to the end of the wire.

Shown two water drainage holes 15 are formed on the inner surface of a back side of the center hole 14 of the closed barrel 13 to be open on the outer surface of the closed barrel 13.

The terminal connecting portion 20 is in the form of a round pin having a diameter smaller than the above wire connecting portion 12 and constant over the entire length. This terminal connecting portion 20 is electrically connected by being tightly inserted into a tubular connecting portion of the mating socket terminal as partly already described.

Figure 4:
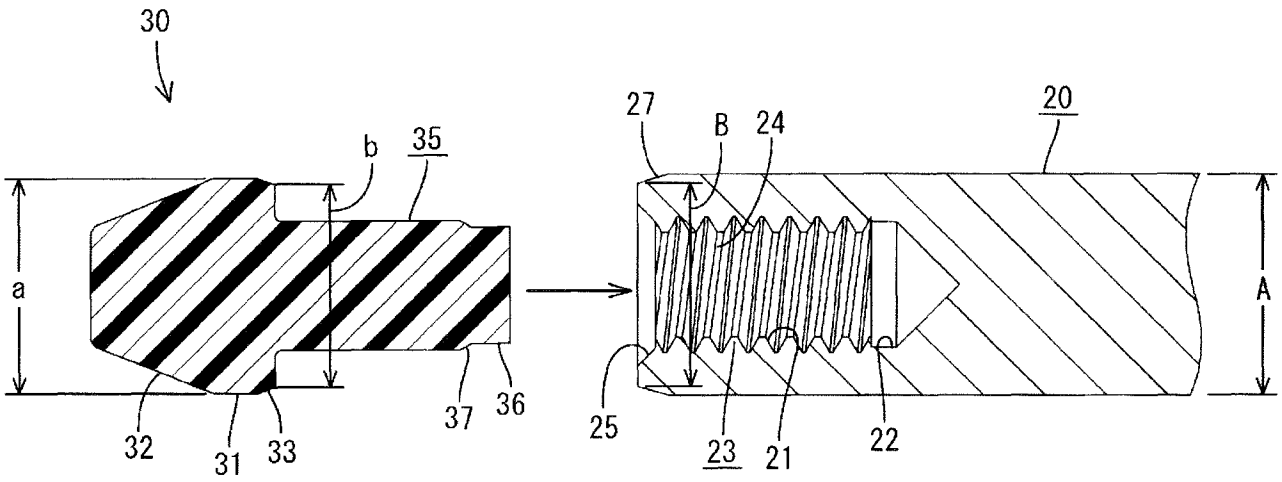
FIG. 4 is a sectional view showing the structure of a press-fitting part of a cap.

The cap 30 is attached to the tip surface of the terminal connecting portion 20. Thus, a screw hole 21 as an attachment hole is formed in the center of the tip surface of the terminal connecting portion 20. Specifically, as shown in FIG. 4, the screw hole 21 is formed by, after forming a lower hole 22 having a predetermined depth by cutting using a drill or the like, forming an internal thread 23 on the inner peripheral surface of this lower hole 22 by a tap or the like. A guide surface 25 widened toward a tip is formed over the entire circumference on the opening edge of the screw hole 21.

Further, a tapered surface 27 gradually narrowed, i.e. tapered toward the front is formed on a corner part of the tip of this terminal connecting portion 20.

The cap 30 is made of synthetic resin and shaped such that a truncated conical portion 32 having a maximum diameter equal to an outer diameter a of a disk portion 31 is coaxially connected to the front surface of the thick disk portion 31 having the outer diameter a slightly smaller than an outer diameter A of the terminal connecting portion 20 of the terminal main body 10 likewise as shown in detail in FIG. 4. Note that a tapered surface 33 gradually narrowed toward the back is formed on a corner part of the rear end of the disk portion 31 and a diameter b of the rear edge of this tapered surface 33 is substantially equal to a diameter B of the tip edge of the tapered surface 27 formed on the corner part of the tip of the terminal connecting portion 20.

A press-fitting portion 35 in the form of a round bar press-fittable into the screw hole 21 formed on the tip surface of the terminal connecting portion 20 of the terminal main body 10 is integrally formed to project in the center of the rear surface of the disk portion 31 of the cap 30. This press-fitting portion 35 has a length to be press-fittable up to a depth position where the internal thread 23 is formed on the screw hole 21.

A small-diameter portion 36 for guiding is formed via an inclined portion 37 on the projecting end of the press-fitting portion 35.

Figure 5:
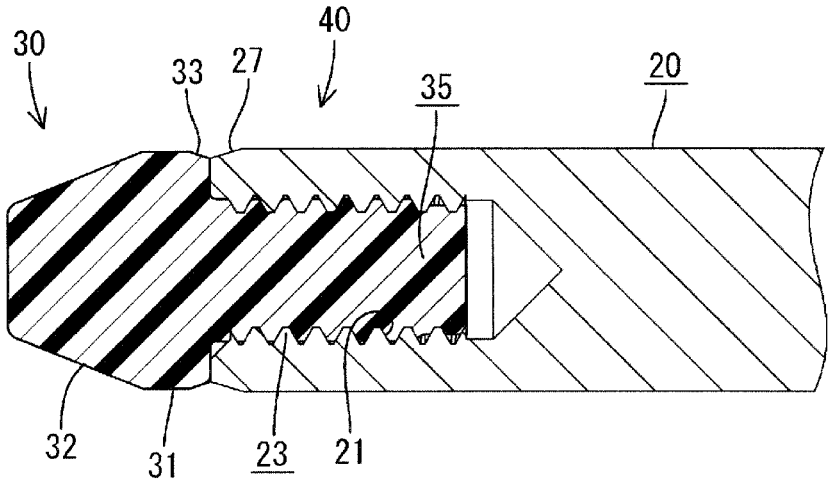
FIG. 5 is a section showing a state where the cap is press-fitted.
Figure 6:
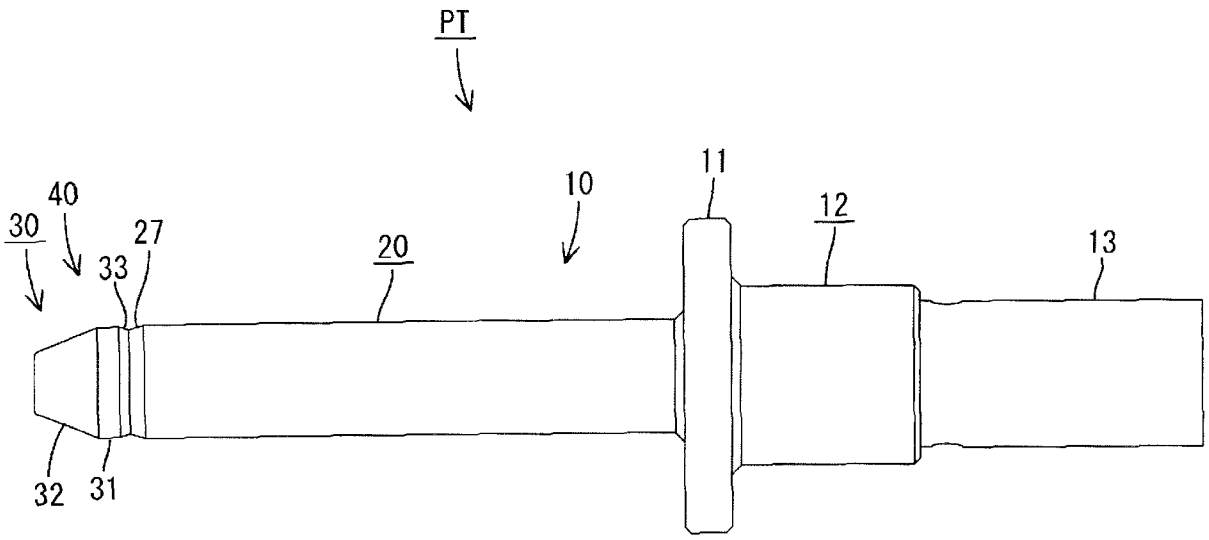
FIG. 6 is a plan view of the pin terminal after being assembled.
Figure 7:
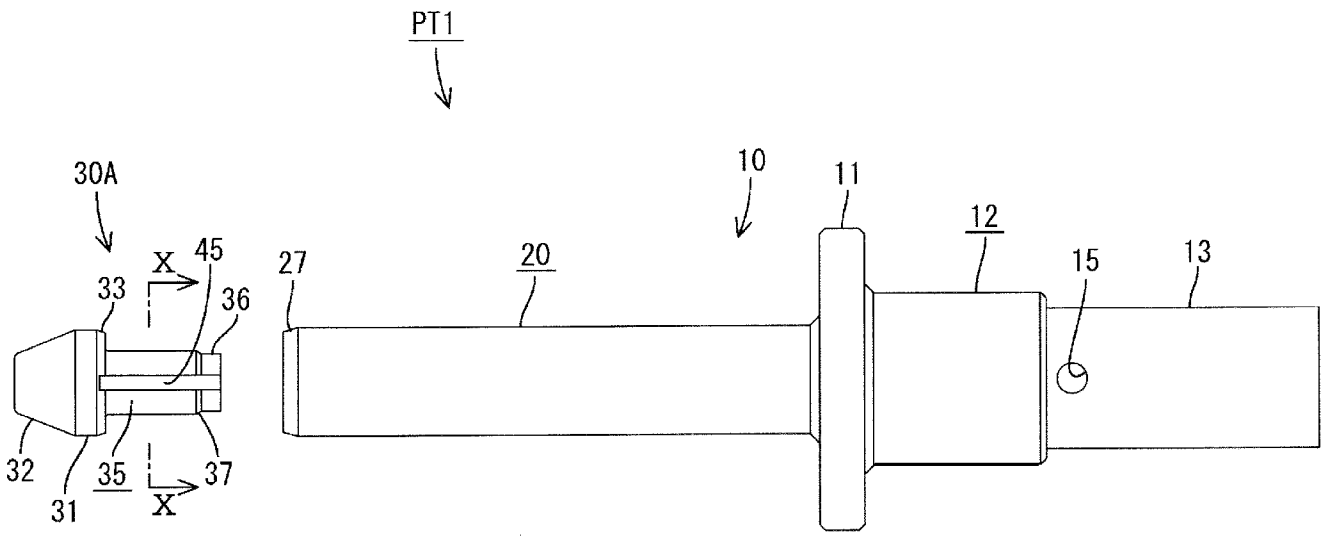
FIG. 7 is a side view showing a state of a pin terminal according to a second embodiment before being assembled.
Figure 8:
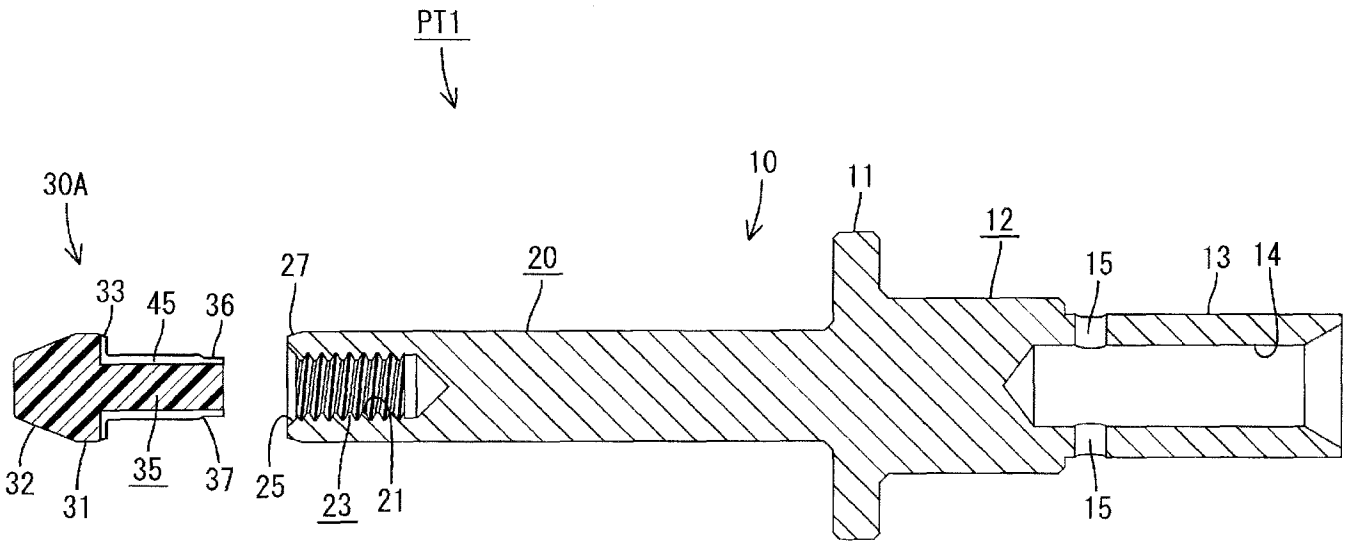
FIG. 8 is a plan view in section of the pin terminal.
Figure 9:
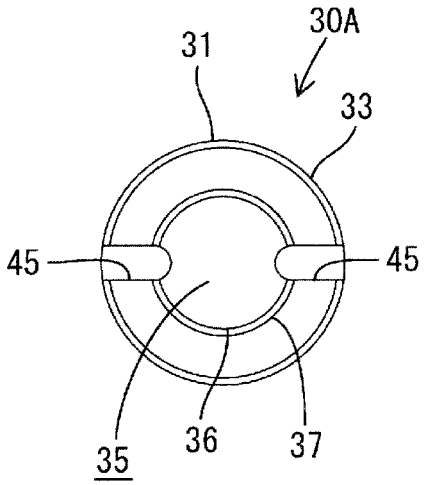
FIG. 9 is a rear view of a cap.
Figure 10:
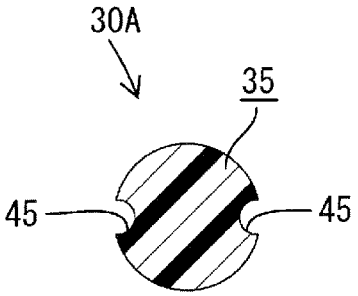
FIG. 10 is a section along X-X of FIG. 7 showing the cap.
Figure 11:
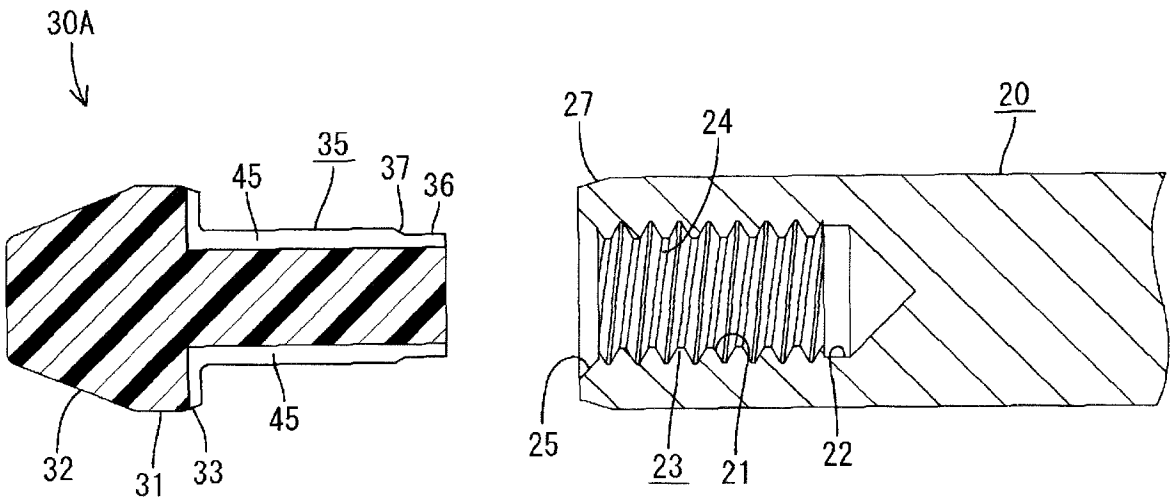
FIG. 11 is a section showing the structure of a press-fitting part of the cap.

This embodiment is structured as described above. In assembling the pin terminal PT, the press-fitting portion 35 of the cap 30 is press-fitted into the screw hole 21 on the tip surface of the terminal connecting portion 20 of the terminal main body 10 as shown by an arrow of FIG. 4. The press-fitting portion 35 is press-fitted with relatively low resistance while being centered by the small-diameter portion 36 on the projecting end coming into contact with the guide surface 25 of the opening edge of the screw hole 21, and press-fitting is stopped when the rear surface of the disk portion 31 of the cap 30 comes into contact with the tip surface of the terminal connecting portion 20 as shown in FIG. 5. In this way, the assembling of the pin terminal PT is completed as shown in FIG. 6.

In the completely assembled pin terminal PT, the projecting end of the press-fitting portion 35 reaches a position of the screw hole 21 where the back end of the internal thread 23 is formed as shown in FIG. 5 when the pressing fitting of the cap 30 is completed.

Further, the rear edge of the tapered surface 33 on the corner part of the rear end of the disk portion 31 of the cap 30 butts against the tip edge of the tapered surface 27 on the corner part of the tip of the terminal connecting portion 20 having the same diameter as the rear edge.

In this way, on the outer periphery of the tip part of the pin terminal PT, the outer periphery of the truncated conical portion 32 of the cap 30, the outer periphery of the disk portion 31, the tapered surface 33 of the cap 30 and the tapered surface 27 of the terminal connecting portion 20 of the terminal main body 10 are connected one after another, thereby forming an entirely smooth and substantially tapered guiding portion 40.

The pin terminal PT is connected to the end of the wire in the already described manner and mounted in the housing of the vehicle side connector, thereby entering a waiting state. At the time of charging, the power-supply side connector connected to an external power supply is connected to the vehicle side connector and the pin terminal PT is inserted into and connected to the mating socket terminal mounted in the power-supply side connector, thereby forming a power feeding path and the like. Such as when charging is completed, the power-supply side connector is pulled out and the pin terminal PT is withdrawn from the socket terminal. At this time, a high current flows in the pin terminal PT depending on a power feeding structure. However, since the cap 30 made of the insulating material is attached to the tip of the pin terminal PT, electrification by contact is prevented.

On the other hand, the pin terminal PT is inserted into and withdrawn from the mating socket terminal every time a charging operation is performed. Particularly, in withdrawing the pin terminal PT, a force acts on the cap 30 in a direction to detach the cap 30 from the terminal main body 10 upon being subjected to a frictional force between the pin terminal PT and the inner periphery of the tubular connecting portion of the socket terminal. However, in this embodiment, since the press-fitting portion 35 formed to project on the rear surface of the cap 30 is press-fitted into the screw hole 21 formed on the tip surface of the terminal connecting portion 20 of the terminal main body 10 in an attachment structure of the cap 30, a large holding force resisting the force acting in the direction to detach the cap 30 can be obtained.

Specifically, the pin terminal PT is easily exposed to high temperature due to the flow of a high current and an arrangement position. Here, since the synthetic resin as the base material of the cap 30 has a higher coefficient of thermal expansion than metal as a base material of the terminal main body 10, the cap is thermally expanded more to have an increased inner diameter and becomes loose on the attachment portion if the cap is structured to be externally press-fitted onto the attachment portion provided on the tip of the terminal main body. Contrary to that, in this embodiment, the outer diameter of the press-fitting portion 35 becomes larger if the cap 30 is thermally expanded and, accordingly, the outer periphery of the press-fitting portion 35 is more tightly held in contact with the inner periphery of the screw hole 21.

Here, if the terminal main body is formed into a cylindrical shape by bending a metal strip material in a width direction and structured such that the press-fitting portion 35 on the rear surface of the cap 30 is press-fitted into a hollow part at the tip of the cylindrical shape, the hollow part is widened while the opposite butting lateral edges of the strip material are separated and close contact cannot be obtained when the press-fitting portion 35 is thermally expanded to have a larger outer diameter as described above.

Contrary to that, in this embodiment, the screw hole 21 as an attachment hole is formed by cutting the tip surface of the terminal connecting portion 20 of the terminal main body 10 that is a solid material, i.e. the screw hole 21 is structured to include an uninterrupted continuous peripheral wall. Thus, even if the press-fitting portion 35 is thermally expanded, the screw hole 21 maintains a constant inner diameter, leaving no room for expansion. Therefore, a degree of press-fitting reliably increases and, as a result, the holding force increases if the outer diameter of the press-fitting portion 35 increases as described above.

In addition, the internal thread 23 is formed on the inner periphery of the screw hole 21. As the press-fitting portion 35 of the cap 30 is press-fitted into the screw hole 21, a ridge portion 24 of the internal thread 23 bites into the press-fitting portion 35 substantially over the entire length, i.e. resistance is created in the detaching direction over a long range of the press-fitting portion 35. Thus, the holding force is further increased.

Specifically, the holding force of the cap 30 onto the terminal main body 10 can be remarkably increased with a simple structure of forming only the projecting press-fitting portion 35 on the cap 30 and, on the other hand, forming the screw hole 21 as an attachment hole on the terminal main body 10.

Further, since the tip structure of the pin terminal PT is such that the smooth and tapered guiding portion 40 is formed from the outer surface of the cap 30 to the tapered surface 27 on the tip part of the terminal connecting portion 20 of the terminal main body 10, the pin terminal PT can be smoothly inserted, i.e. an inserting force can be reduced in inserting the pin terminal PT into the tubular connecting portion of the mating socket terminal.

<Second Embodiment>

Next, a second embodiment of the present invention is described with reference to FIGS. 7 to 13.

In this second embodiment, a cap 30A has a different structure. Specifically, two longitudinal grooves 45 for air vent extending in a length direction are formed at an interval of 180° on the outer periphery of a press-fitting portion 35 of the cap 30A.

Specifically, each longitudinal groove 45 is formed to extend from the projecting end surface of the press-fitting portion 35 to a base end side thereof and then along the rear surface of a disk portion 31 and to be open on the outer peripheral edge of the disk portion 31. Further, the longitudinal grooves 45 have such a depth that a constant clearance can be formed between the bottoms of the longitudinal grooves 45 and the top of a ridge portion 24 of an internal thread 23 when the press-fitting portion 35 is press-fitted into a screw hole 21 on the tip surface of a terminal connecting portion 20 of a terminal main body 10.

The other structure is as in the first embodiment and members and components having the same functions as in the first embodiment are denoted by the same reference signs and described only briefly or not at all.

Since the first embodiment is structured such that air is sealed at the back of the screw hole 21 as shown in FIG. 5 when the press-fitting portion 35 of the cap 30 is press-fitted into the screw hole 21, a force in the detaching direction may act on the press-fitting portion 35, i.e. on the cap 30 if this air is thermally expanded when the pin terminal PT is exposed to high temperature.

Figure 12:
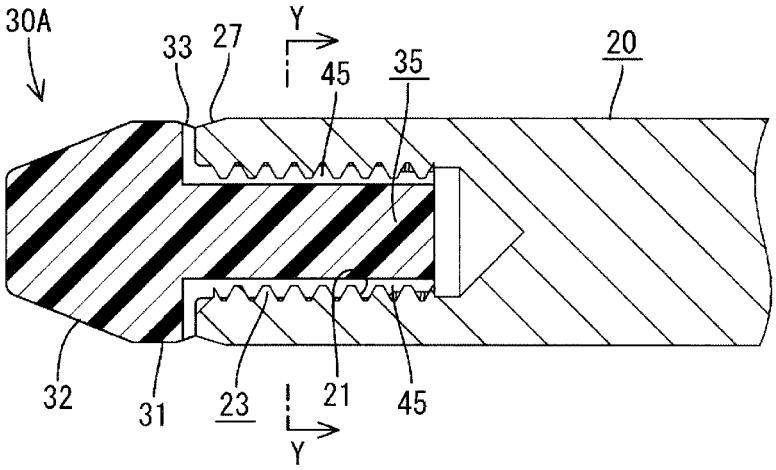
FIG. 12 is a section showing a state where the cap is press-fitted.
Figure 13:
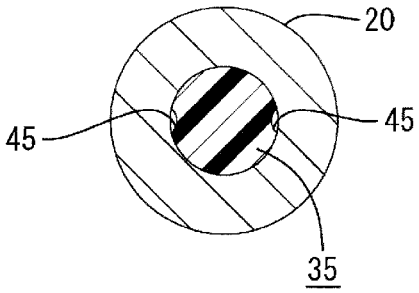
FIG. 13 is a section along Y-Y of FIG. 12.

Contrary to that, since two longitudinal grooves 45 are formed on the outer periphery of the cap 30A in a pin terminal PT1 of this embodiment, even if air is expanded, this air is allowed to escape to the outside through the longitudinal grooves 45 as shown in FIG. 12, whereby the action of a force in the detaching direction on the cap 30A is avoided and, although indirectly, the holding force of the cap 30A is further increased.

The present invention is not limited to the above described and illustrated embodiments. For example, the following embodiments are also included in the technical scope of the present invention.

Although the spiral internal thread is formed to form a biting protrusion on the inner periphery of the attachment hole in the above embodiments, a plurality of circumferential grooves may be formed at intervals. Alternatively, only one circumferential groove may be formed.

The formation of the biting protrusion on the inner periphery of the attachment hole may be omitted. Such a mode is also included in the technical scope of the present invention.

In the second embodiment, one, three or more longitudinal grooves may be formed on the press-fitting portion of the cap.

Even if the pin terminal is structured such that the terminal main body is formed into a cylindrical shape by bending a metal strip material in the width direction and the press-fitting portion on the rear surface of the cap is press-fitted into a hollow interior at the tip of the terminal main body as an attachment hole, such a structure is applicable, in short, if the attachment hole includes an uninterrupted peripheral wall over the entire circumference, leaving no room for expansion such as by fixing the butting lateral edges of the strip material by welding.

Although the pin terminal applied to the charging connector is illustrated in the above embodiments, the present invention can be similarly applied to pin terminals in general used in other applications.

The invention claimed:

1. A pin terminal, comprising:

a terminal main body having a terminal connecting portion extending in forward and backward directions, a screw hole formed in a front end of the terminal connecting portion and having an array of internal threads extending in an axial direction, and defining a helical ridge of uniform diameter; and a cap formed form synthetic resin having a disk portion and a press-fitting portion projecting rearward from the disk portion, the press-fitting portion being press-fit into the screw hole of the terminal main body, wherein the at least one ridge portion bites into the press-fitting portion to define a helical engagement over an entire length of the press-fitting portion.

2. The pin terminal of claim 1, wherein a longitudinal groove for air vent is formed over an entire length on an outer periphery of the press-fitting portion of the cap.

3. The pin terminal of claim 1, wherein the terminal body further comprises a flange rearward of the terminal connecting portion and a wire connecting portion rearward of the flange.

4. The pin terminal of claim 3, wherein a center hole is formed in a rear surface of the wire connecting portion, and at least one drainage hole is formed in the center hole.

5. The pin terminal of claim 1, wherein an inclined guide surface is formed over an entire circumference of the front end of the terminal connecting portion for guiding the cap into the screw hole.

6. The pin terminal of claim 1, wherein the terminal connecting portion has an outer peripheral surface, and a rearwardly inclined tapered surface is formed on the outer peripheral surface at the front end.

7. The pin terminal of claim 1, wherein the cap is formed with a truncated conical portion forward of the disk portion, and a diameter of the truncated conical portion increases between a leading end and the disk portion.

8. The pin terminal of claim 1, wherein a diameter of the press-fitting portion is smaller than a diameter of the disk portion.

9. The pin terminal of claim 1, wherein the internal threads extend between a proximal end at the front end of the terminal connecting portion and a distal end spaced rearwardly from the proximal end, and a length of the press-fitting portion is equal to a length of the internal threads between the proximal end and the distal end.

* * * * *